US005725039A

United States Patent [19]

Macinai et al.

[11] Patent Number: 5,725,039

[45] Date of Patent: Mar. 10, 1998

[54] HANDBAG WITH REVERSIBLE FLAP

[75] Inventors: Maurizio Macinai, Scandicci, Italy; Kellee Hughes; Stephen Gatsik, both of New York, N.Y.

[73] Assignee: Manetti Farrow Incorporated, New York, N.Y.

[21] Appl. No.: 665,677

[22] Filed: Jun. 18, 1996

[51] Int. Cl.[6] ..... A45C 3/08; A45C 13/08; A45C 13/12

[52] U.S. Cl. ..... 150/104; 150/105; 150/118

[58] Field of Search ..... 150/103–105, 150/118

[56] References Cited

U.S. PATENT DOCUMENTS

| | | | |
|---|---|---|---|
| 1,570,515 | 1/1926 | Meltzer | 150/105 |
| 1,587,891 | 6/1926 | Berkowitz | 150/103 |
| 1,747,801 | 2/1930 | Topac | 150/104 |
| 1,927,590 | 9/1933 | Isaacson | 150/105 |
| 1,990,360 | 2/1935 | Anish | 150/105 |
| 2,080,453 | 5/1937 | Kraut | 150/104 |
| 3,182,701 | 5/1965 | Ginsburg | 150/105 |
| 5,503,204 | 4/1996 | Byers et al. | 150/105 |

FOREIGN PATENT DOCUMENTS

| | | | |
|---|---|---|---|
| 211587 | 10/1960 | Austria | 150/118 |
| 1233538 | 10/1960 | France | 150/118 |
| 2629794 | 10/1989 | France | 150/103 |
| 223823 | 10/1924 | United Kingdom | 150/105 |
| 2260894 | 5/1993 | United Kingdom | 150/105 |

*Primary Examiner*—Sue A. Weaver
*Attorney, Agent, or Firm*—Notaro & Michalos P.C.

[57] ABSTRACT

A handbag with a reversible flap has a handbag body with a open top. The flap has inner and outer panels, each with surfaces that can be selectively exposed to change the appearance of the handbag. The flap has a front cover portion that covers the front of the handbag body and a rear attachment portion with a pair of snaps which mate with a complimentary pair of snaps in a rear pocket of the handbag. The snaps on the flap are double-sided. The inner and outer panels are attached to each other only around the periphery of the front cover portion to allow the relative sliding between the inner and outer panels in the bend portion and rear attachment portion of the flap. This avoids the creation of creases in the bend portions as the flap is first used in one position and then bent to be used in the opposite position.

20 Claims, 2 Drawing Sheets

HANDBAG WITH REVERSIBLE FLAP

FIELD AND BACKGROUND OF THE INVENTION

The present invention relates in general to handbags, and in particular to a new and useful handbag with a removable and reversible flap.

Various patents disclose the use of removable flaps and the concept of using different flaps for changing the appearance of the handbag. See, for example, U.S. Pat. No. 1,747,801. U.S. Pat. No. 1,570,515 discloses a handbag having a covering with one appearance on one side and a different appearance on the other side. A reversible flap is also disclosed by U.S. Pat. No. 1,587,891. A reversible and removable flap is disclosed by U.S. Pat. No. 1,927,590. A recent patent, U.S. Pat. No. 5,503,204, also discloses a removable flap which utilizes turn buckles as fasteners rather than snaps.

An inherent problem, which has not been solved by the prior art, is that if the handbag flap, advantageously made of leather, is used for a long period of time while being bent in one direction, it will resist bending in the opposite direction. Unsightly wrinkles, and even cracks, may form on the inside of the bend, which then mar the appearance of the flap when the flap is reversed.

SUMMARY OF THE INVENTION

An object of the present invention is to provide a handbag having a reversible flap, which has a construction that can accommodate bending of the flap, first in one direction, and then in an opposite direction, without damaging the two outer surfaces of the flap. The outer surfaces can be of different colors, textures or the like so that when the flap is bent in one direction, the handbag has one appearance and when it is bent in the opposite direction, the handbag has a very different appearance.

The present invention also provides an omni-directional fastening mechanism, which allows the flap to be closed against magnetic posts when the flap is in either position.

Accordingly, the present invention comprises a handbag with a reversible and removable flap. The handbag includes a functional rear pocket which also contains a pair of hidden snaps. A flap to be used with the handbag has a pair of mating snaps at one end, which can be snapped into the pocket. In this way, the attachment end of the flap is concealed. The other end of the flap, which wraps around to the front of the handbag, is provided with a separate magnetic fastener in the form of a metal bar inside the flap and at least one magnet advantageously located in the handbag. The magnetic fastener functions regardless of which side of the flap faces outward.

The open top of the handbag is also provided with a strap and fastener for closing the handbag when no flap is used.

According to one feature of the invention, different flaps made of different materials can be used with the handbag to drastically change the appearance of the handbag. Each flap is also reversible and is made of two layers of materials having different outward appearances and which are fastened to each other by a seam that extends only around the front portion of the flap.

The portions of the flap corresponding to the bend and the attachment end of the flap, do not include a seam in order to allow relative sliding between the two layers of the flap for permitting the flap to be bent in one direction for use with one surface visible, and then in an opposite direction for use with the opposite surface visible. The metal bar of the magnetic fastener is between the front parts of the two layers.

The attachment end of the flap contains slots through both layers which receive a two-sided snap so that the snap does not constrict the relevant movement between the two layers of the flap. The slots are provided to permit the flap to be bent in both directions, without obstruction.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
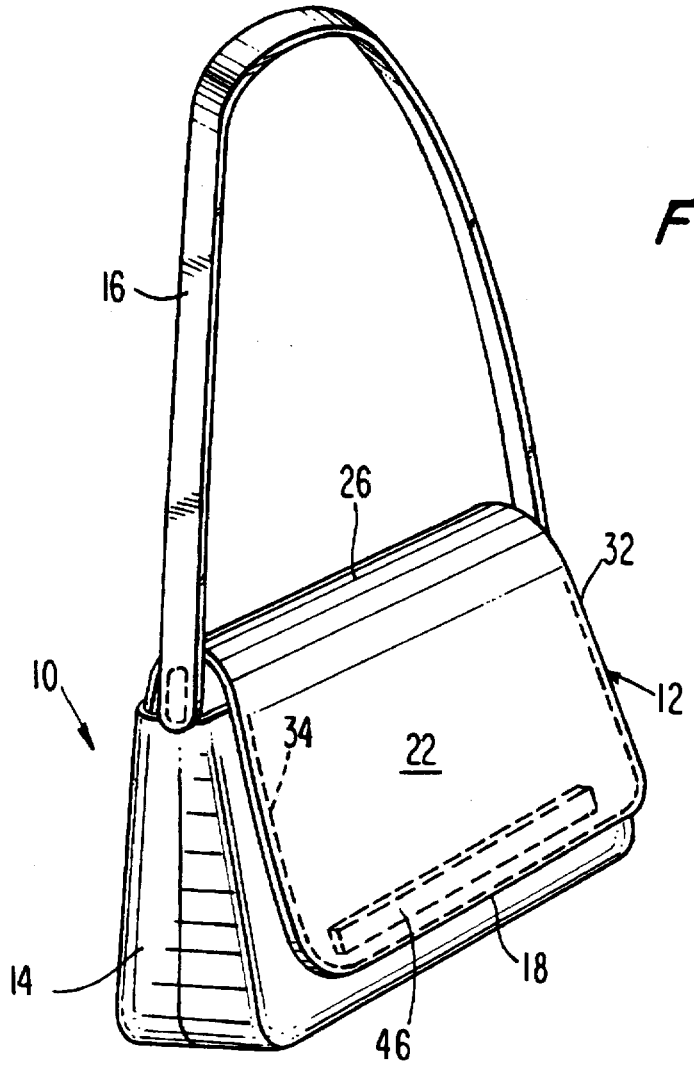
FIG. 1 a front perspective view of a handbag with reversible flap, according to the present invention.

Referring to the drawings in particular, the invention embodied in FIG. 1 comprises a handbag, generally designated 10, with a removable and reversible flap 12, which is shaped and sized to cover the top and most of the front of the handbag body 14. A shoulder strap 16 has opposite ends connected, for example, with stitches or other conventional means, to the upper sides of the handbag body 14.

Figure 2:
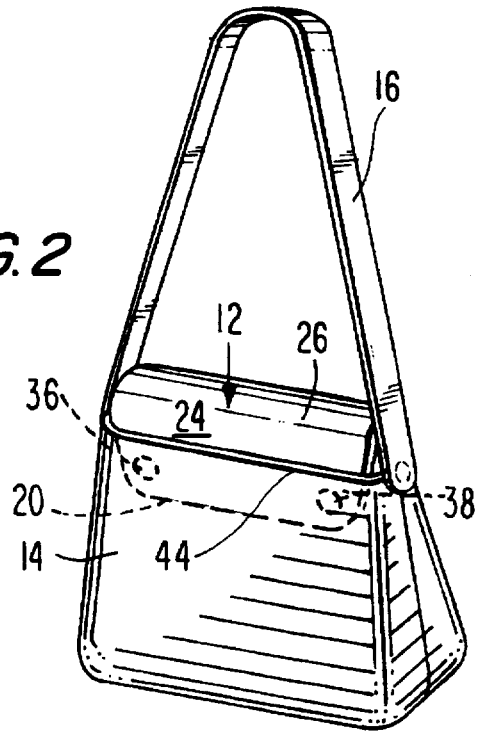
FIG. 2 is a rear perspective view thereof.

Flap 12 has a first front end 18 and an opposite rear end 20, as shown in FIG. 2. Flap 12 also includes a front cover portion 22 for covering part or most of the front of the handbag body 14, and a rear attachment portion 24 which extends to the rear of body 14. A bend portion 26 connects the front and rear portions 22, 24.

Figure 4:
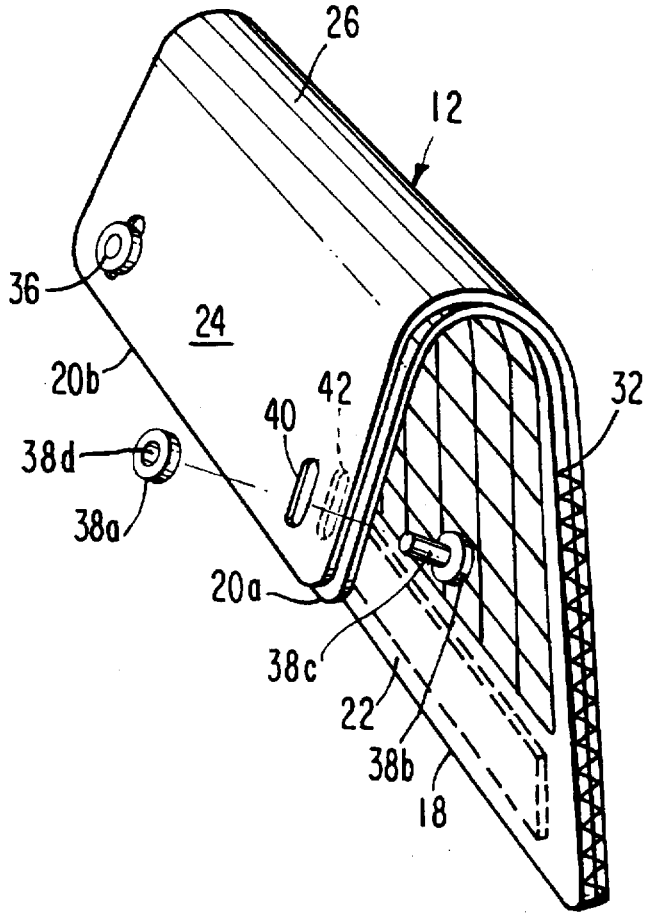
FIG. 4 is a rear perspective view of the removable and reversible flap of the present invention.

As best shown in FIG. 4, the detachable and reversible flap 12 is advantageously made of two layers of materials, for example, inner and outer leather panels. Advantageously, the inner surface of the inner panel has a different color and/or texture than the outer surface of the outer panel as clearly shown in FIG. 4. For example, the outer surface may be shiny patent leather while the inner surface can have an alligator pattern, as shown in FIG. 4.

Due to the bending of the flap in one direction, the layer forming the inner panel will be forced to bend with a smaller radius of curvature than the outer panel in the bent portion 26. This will cause the rear edge 20i aof the rear end of the inner panel to slide downwardly with respect to the rear edge **20*b*** of the outer panel. If the two panels were attached to each other completely around their periphery, this relative movement would be precluded, and the inner panel would tend to deform, bend and buckle to compensate for the strain placed on it. Then, when the flap is bent in the opposite direction to expose the outer surface of the inner panel, these bends and buckles would be revealed as creases, and possibly even cracks, on the outer surface of the flap. At the same time, similar creases, bends, and perhaps cracks, would be formed on the outer surface of the now inner panel, which would be particularly devastating if the panel were made of patent leather.

To avoid this problem and to allow the inner and outer flaps to slide with respect to each other in the attachment portion of the flap 12, the panels are attached to each other only partly around their periphery, and advantageously only at the front end 18, or at most, the front cover portion 22 of the flap 12. This can be achieved using a stitch or a seam, as shown on flap 12 in FIG. 1, which has a beginning point at 32 and an ending point at 34. Intermittent means, for example rivets, or spaced apart stitches, or any other known mechanism for attaching panels of a handbag can be used to secure the panels together.

The rear attachment portion 24 of the panel is detachably connected to the handbag body 14 by a pair of double snaps 36, 38. Either double female snap portions or double male snap portions can be utilized.

As shown in FIG. 4, each of the double snaps comprises an outer portion 38*a* and an inner portion 38*b*, which can be connected to each other, for example by a rivet shaft 38*c* which extends through aligned elongated slots 40, 42 which are in the inner and outer panels of the flap, respectively. Slots, rather than holes, are used to receive the rivet shaft 38*c*, so that when the two snap halves 38*a*, 38*b* are attached to each other, the slots will still permit relative sliding between the inner and outer panels of the rear attachment portion 24. Attachment of the inner and outer snap portions can be achieved in conventional fashion by extending the rivet shaft 38*c* through a hole 38*d* in the snap portion 38*a* and then using a grommet tool for expanding the end of the shaft 38*c*. Care must be taken to avoid crimping the two snap portions 38*a*, 38*b* too closely toward each other, since this would fix the double layer of panel material and prevent the relative sliding which is essential for the present invention.

To ensure that the handbag 10 of the present invention looks like a conventional handbag, rather than a handbag having a removable flap, a rear fully functional pocket is provided on the handbag body 14 having an opening 44. In the interior of the pocket, adjacent opening 44, complimentary snap portions are provided for receiving the snaps 36, 38. Since both snaps 36 and 38 are double sided, the same pair of complimentary snaps in the pocket will engage with the flap 12, regardless of which surface is exposed.

The front cover portion 22 of the flap is held against the front of the handbag body 14 by a magnetically attractable elongated bar 46. Bar 46 is magnetically attracted to one long magnet or a pair of magnets 48, 50 within the front wall of the handbag body 14. By using an elongated bar 46, which is placed between the inner and outer panels of the flap 12 and captured, for example, using stitches or other conventional means, the front cover portion of the flap is held against the front of the handbag body, regardless of which surface of the flap is exposed.

Figure 3:
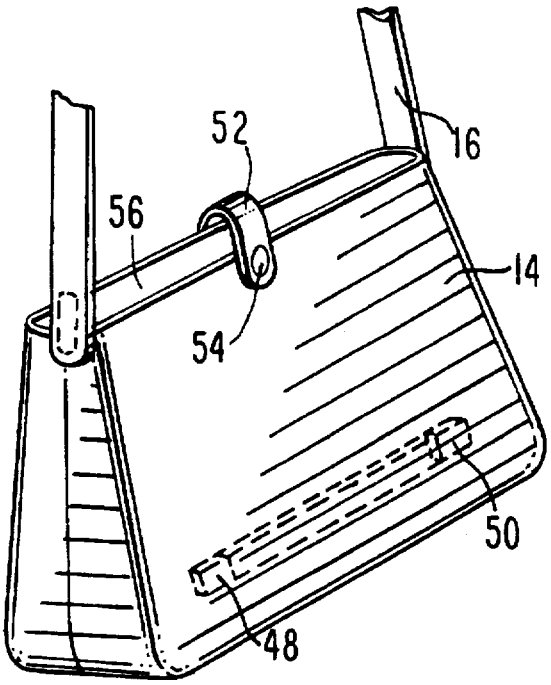
FIG. 3 is a partial front perspective view of the handbag of the present invention but with the flap removed.

As shown in FIG. 3, a strap 52 which can be sewn against the rear inner wall of handbag body 14 is provided with a front snap 54 for engaging a complimentary snap on the front wall of handbag body 14 to close the top opening 56 of the handbag when the removable flap 12 is removed for yet a third different appearance. The concealed magnets 48, 50 are utilized so that only the outer surface of the handbag body 14 is visible when the removable flap 12 is removed for use of the handbag body 14 with the strap 52 only.

While a specific embodiment of the invention has been shown and described in detail to illustrate the application of the principles of the invention, it will be understood that the invention may be embodied otherwise without departing from such principles.

What is claimed is:

1. A handbag with a reversible flap, comprising:

a handbag body having an open top, a front and a rear;

a flap having a front cover portion for covering at least part of the front of the handbag body, a rear attachment portion and a bend portion between the front and rear portions for bending over the open top of the handbag body;

the flap comprising an inner panel having an inner surface and an outer panel having an outer surface, the inner and outer panels being connected to each other at least at a part of the front cover portion and being free of each other at the bend portion and at the attachment portion so that bending of the flap in one direction permits relative sliding of the panels in the bend and rear attachment portions so that at one time, the bend portion can be bent in one direction for exposing the outer surface and, at a different time, the bend portion can be bent in an opposite direction for exposing the inner surface, the relative sliding of the panels in the bend and attachment portions accommodating bending of the bend portion without damaging the inner and outer surfaces;

at least one first attachment member connected to the rear of the handbag body; and at least one double-sided second attachment member connected to the rear attachment portion of the flap for detachably engaging the first attachment member for connecting the flap to the body.

2. A handbag according to claim 1, wherein the inner and outer surfaces are different from each other.

3. A handbag according to claim 2, wherein the handbag body includes a functional pocket at the rear of the body, the functional pocket having an open top, the first attachment member being in the functional pocket so that with the double-sided second attachment member being engaged with the first attachment member, at least part of the rear attachment portion is concealed within the pocket.

4. A handbag according to claim 3, including a magnetically attractable elongated bar in the front cover portion between the inner and outer panels, and at least one magnetically attractable member in the front of the handbag body for attracting the bar to hold the front cover portion of the flap against the front of the body.

5. A handbag according to claim 4, including a plurality of magnetically attractable members spaced from each other in the front of the handbag body and positioned for each attracting the bar.

6. A handbag according to claim 5, wherein the inner and outer panels are attached to each other around at least part of a perimeter of the front cover portion.

7. A handbag according to claim 6, wherein the inner and outer panels are attached to each other around the front end and sides of a perimeter of the front cover portion.

8. A handbag according to claim 7, wherein the inner and outer panels are attached to each other with stitches which end at the bend portion.

9. A handbag body according to claim 8, wherein the first attachment member is a male or female snap and the double-sided second attachment member is a double-sided female or male snap respectively.

10. A handbag body according to claim 1, wherein the first attachment member is a male or female snap and the double-sided second attachment member is a double-sided female or male snap respectively.

11. A handbag according to claim 1, wherein the handbag body includes a functional pocket at the rear of the body, the functional pocket having an open top, the first attachment member being in the functional pocket so that with the double-sided second attachment member being engaged with the first attachment member, at least part of the rear attachment portion is concealed within the pocket.

12. A handbag according to claim 1, including a magnetically attractable elongated bar in the front cover portion between the inner and outer panels, and at least one magnetically attractable member in the front of the handbag body for attracting the bar to hold the front cover portion of the flap against the front of the body.

13. A handbag according to claim 12, including a plurality of magnetically attractable members spaced from each other in the front of the handbag body and positioned for each attracting the bar.

14. A handbag according to claim 1, wherein the inner and outer panels are attached to each other around at least part of a perimeter of the front cover portion.

15. A handbag according to claim 14, wherein the inner and outer panels are attached to each other around the entire perimeter of the front cover portion.

16. A handbag according to claim 15, wherein the inner and outer panels are attached to each other with stitches which end at the bend portion.

17. A handbag according to claim 1, including aligned slots in the inner and outer panels of the rear attachment portion; said double-sided attachment member having inner and outer portions connected to each other through the aligned slots.

18. A handbag according to claim 17, including a pair of spaced apart aligned slots in the inner and outer panels of the rear attachment portion and a pair of double-sided second attachment members, each with inner and outer portions connected to each other through respective aligned slots, the handbag including a pair of first attachment member on the rear of the body.

19. A handbag according to claim 18, wherein the attachment members are snap portions.

20. A handbag according to claim 19, including a magnetically attractable bar in the front cover portion between the inner and outer panels and a magnetically attracted member in the front of the handbag body for attracting the bar to hold the front cover portion against the front of the body.

* * * * *